US005637072A

United States Patent [19]

Michaelis

[11] Patent Number: 5,637,072

[45] Date of Patent: Jun. 10, 1997

[54] APPARATUS FOR ADJUSTING OF THE FOLDING JAWS OF A FOLDING JAW CYLINDER

[75] Inventor: Friedrich Michaelis, Augsburg, Germany

[73] Assignee: MAN Roland Druckmaschinen AG, Offenbach am Main, Germany

[21] Appl. No.: 386,274

[22] Filed: Feb. 9, 1995

[30] Foreign Application Priority Data

Feb. 15, 1994 [DE] Germany ..... 44 04 752.5

[51] Int. Cl.[6] ..... B31F 1/10

[52] U.S. Cl. ..... 493/476; 493/475; 493/424; 493/425; 493/426

[58] Field of Search ..... 493/471, 475, 493/476, 424, 425, 426, 427, 428, 429, 430, 431, 432, 433, 434

[56] References Cited

U.S. PATENT DOCUMENTS

| | | | |
|---|---|---|---|
| 4,345,906 | 8/1982 | Gregoire . | |
| 4,778,166 | 10/1988 | Nanba et al. | 493/428 |
| 4,790,804 | 12/1988 | Gotou et al. | 493/426 |
| 5,000,433 | 3/1991 | Prüm et al. | 493/424 |
| 5,057,064 | 10/1991 | Michalik | 493/476 |
| 5,096,175 | 3/1992 | Lange et al. | 493/425 |
| 5,201,701 | 4/1993 | Roettger et al. | 493/476 |
| 5,215,014 | 6/1993 | Burger et al. | 493/424 |
| 5,417,642 | 5/1995 | Boronka et al. | 493/425 |
| 5,443,437 | 8/1995 | Mack | 493/476 |

FOREIGN PATENT DOCUMENTS

| | | |
|---|---|---|
| 3143011 | 5/1982 | Germany . |
| 3220414 | 12/1983 | Germany . |
| 3838314 | 5/1990 | Germany . |
| 54-174425 | 5/1953 | Japan . |
| 46-2523 | 1/1971 | Japan . |
| 61-86368 | 1/1986 | Japan . |
| 62-8970 | 1/1987 | Japan . |
| 62-70174 | 3/1987 | Japan . |

*Primary Examiner*—Joseph J. Hail, III
*Assistant Examiner*—Darren Ark
*Attorney, Agent, or Firm*—Cohen, Pontani, Lieberman, Pavane

[57] ABSTRACT

An apparatus for the adjustment of folding jaws, in which the cylinder body supports the noncontrolled folding jaw and, for the purpose of its adjustment, is supported on the cylinder shaft so as to be swivelable. The cylinder body further contains a swivelable support in which the controlled folding jaw is supported eccentrically to the swivel axis of the support. A gear unit acts on the support and swivels it so that the controlled folding jaw is moved in the opposite direction of the noncontrolled folding jaw.

7 Claims, 10 Drawing Sheets

APPARATUS FOR ADJUSTING OF THE FOLDING JAWS OF A FOLDING JAW CYLINDER

BACKGROUND OF THE INVENTION

1. Field of the Invention

The invention is directed to an apparatus for adjusting the folding jaws of a folding jaw cylinder of a web-fed rotary printing machine, in which a support member is swivelably mounted in the cylinder. The support member receives the controlled folding jaw eccentrically to its swivel axis so that the controlled folding jaw is swivelable by the spindle of the support member. A roller lever with a roller is provided for controlling the controllable folding jaw.

2. Discussion of the Prior Art

An apparatus of this type for adjusting the folding jaws of a folding jaw cylinder is disclosed in DE-PS 25 37 920. This adjustment is used for adapting to different product thicknesses or for changing the clamping force of the folding jaws and is carried out toward or away from the folding blade as uniformly as possible for each folding jaw. In so doing, the one-piece cylinder body of a folding jaw cylinder is arranged in a stationary manner on the cylinder shaft. A support on which the noncontrolled folding jaw is arranged is accommodated in the cylinder body so as to be swivelable. Further, the spindle of the controlled folding jaw is supported in the support eccentrically to the swivel axis of the support. By rotating the support, both folding jaws are adjusted at the same time. For the purpose of controlling the folding jaw, a cam disk/coupling gear unit acts on the spindle of this folding jaw. The coupling gear unit is loaded by very great masses to be accelerated during each lift of the cam. In so doing, large inertia forces occur resulting in a high degree of wear in the gear unit. In frictional-engagement cam gear units, these inertia forces also cause a high spring pretensioning in the cam roller, which also increases wear. Finally, the coupling gear unit is expensive to produce.

Further, DE 42 15 911 A1 discloses a device in which the controlled folding jaw is adjusted by rotating the cylinder body of the folding jaw cylinder relative to the folding blade. The adjustment of the noncontrolled folding jaw, which is effected in the opposite direction, is carried out by a rotating body which swivels the noncontrolled folding jaw during a relative movement between the rotating body and the cylinder body via controlling means. The swivelable support of this noncontrolled folding jaw in the cylinder body is disadvantageous.

SUMMARY OF THE INVENTION

The object of the present invention is to provide an apparatus for adjusting folding jaws which is constructed economically from a small number of parts and is distinguished by small masses to be accelerated when controlling the folding jaws.

Pursuant to this object, and others which will become apparent hereafter, one aspect of the present invention resides in an adjusting apparatus wherein the cylinder body is rotatably supported on the cylinder shaft and the noncontrolled folding jaw is fastened to the cylinder body. A gear unit acts on the support member and when the cylinder body rotates in the direction of the non-controlled folding jaw away from the controlled folding jaw, or vice versa, the gear unit imparts a swivelling movement to the support member in a direction which causes the controlled folding jaw to be swivelled in a direction opposite to the movement of the non-controlled folding jaw. The roller lever and roller for controlling the controllable folding jaw are fastened to a spindle which passes through the cylinder and the support member.

The apparatus adjusts the two folding jaws very accurately, i.e., by roughly equal amounts away from one another, toward one another and relative to the folding blade of an adjacent cylinder. In this way, it is possible to accurately adjust to changing product thicknesses or to change the clamping force. Moreover, no coupling gear unit is required for controlling the controlled folding jaw so that the inertia forces of the control gear unit can be kept low. As a result, the spring pretensioning for the roller lever of a frictionally engaging cam disk gear unit can be kept low. This results overall in low wear on the control gear unit. Moreover, the apparatus can be produced economically due to the simple construction of the individual component parts. Furthermore, the noncontrolled folding jaw is advantageously fastened to the cylinder body in a simple and stable manner.

Pursuant to another embodiment of the invention, a first spur gear is arranged in a stationary manner on the cylinder shaft and a second spur gear is connected in a stationary manner with the cylinder body and is arranged on the cylinder shaft so as to be rotatable. Two axially displaceable spur gears of different pitch are connected with one another in a stationary manner and engage with the first and second spur gears.

Still another embodiment of the invention provides a segment member arranged on the cylinder in a stationary manner. A spindle nut is mounted to the cylinder body and a threaded spindle is screwed into the spindle nut. The threaded spindle is also mounted to the segment member so as to be non-displaceable.

In another embodiment of the invention, a segment member with internal teeth is arranged on the cylinder shaft in a stationary manner. A pinion is mounted on the support member and engages with the internal teeth of the segment member.

In yet an additional embodiment, the invention provides a crosspiece arranged on the cylinder shaft in a stationary manner. A coupling connects the support member and the crosspiece with one another in an articulated manner and the coupling is articulated to the support member eccentrically to the swivel axis of the support member.

In still yet another embodiment of the invention, a first spur gear is arranged concentrically to the axis of the cylinder body and is connected therewith in a stationary manner. A second spur gear is rotatably arranged adjacent to the first spur gear and concentric to the axis of the cylinder body. Two axially displaceable spur gears of different pitch are connected with one another in a stationary manner and are arranged to mesh with the first and second spur gears. A third spur gear is connected to the axially displaceable spur gears so as to be fixed with respect to rotation relative thereto. The third spur gear engages a fourth spur gear which is arranged in a stationary manner on the cylinder shaft. The second spur gear and the support member are connected with one another in an articulated manner by a coupling which is articulated to the support member eccentrically to the swivel axis of the support member.

Still a further embodiment of the invention provides a first segment member arranged in a stationary manner on the cylinder shaft and a second segment member mounted to be swivelable about the cylinder shaft. A first spindle nut is mounted to the cylinder body and a second spindle nut is mounted to the second segment member. A threaded spindle is supported in the segment member so as to be fixed with respect to displacement. The spindle has a first spindle part screwed into the first spindle nut arid a second spindle part screwed in the second spindle nut, both spindle parts having threads with different pitches. The second segment member and the support member are connected with one another in an articulated manner by a coupling that is articulated at the support member eccentrically relative to the swivel axis of the support member.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
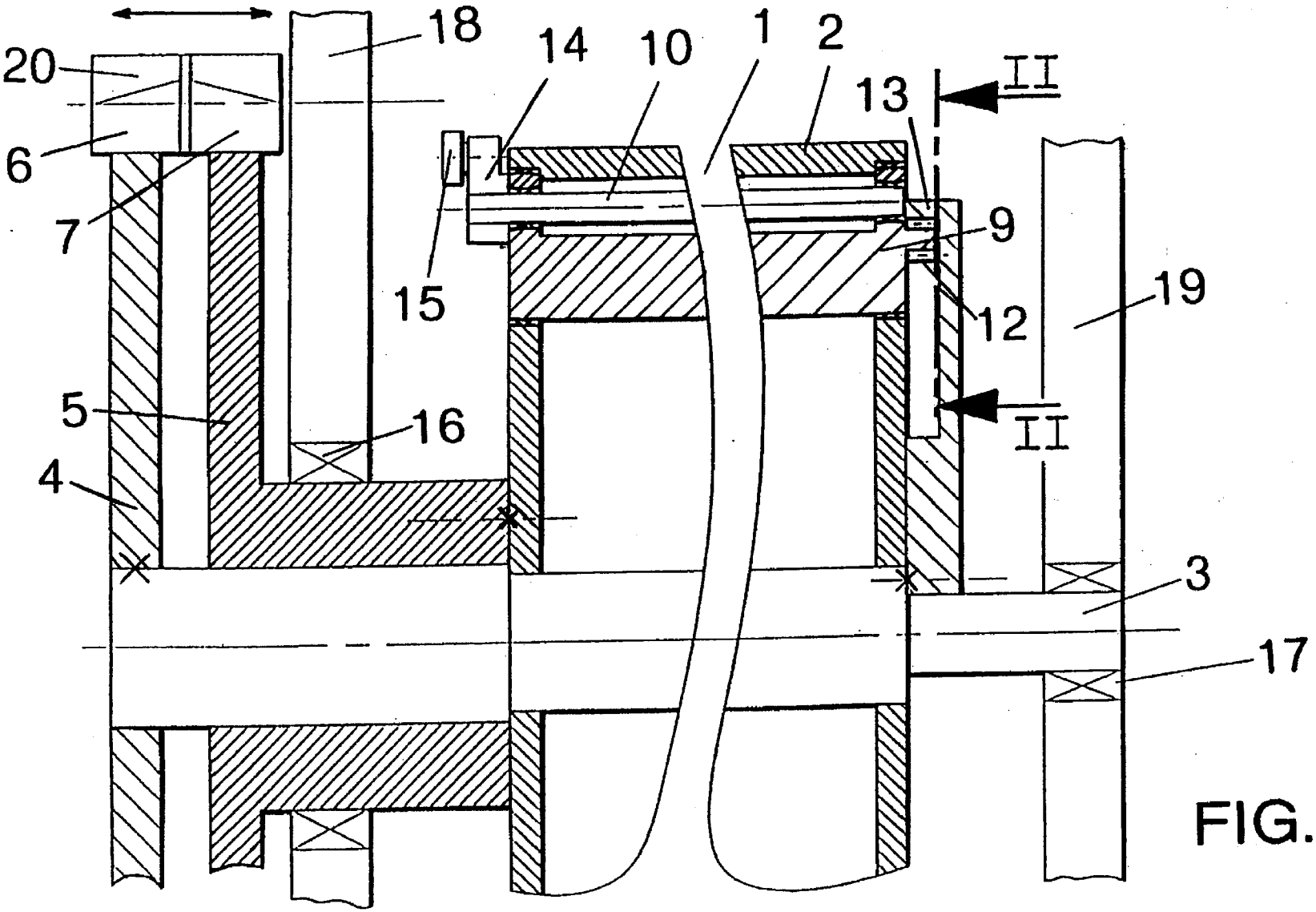
FIG. 1 is a longitudinal section of a folding jaw cylinder with an apparatus for adjusting the folding jaws.

The folding jaw cylinder 1 shown in FIG. 1 contains a cylinder body 2 which is supported on a cylinder shaft 3 so as to be rotatable. A first spur gear 4 is arranged in a stationary manner on the cylinder shaft 3 and a second spur gear 5 is arranged on the cylinder shaft 3 so as to be rotatable. The two spur gears 4, 5 have the same number of teeth and different pitch and engage with two axially displaceable spur gears 6, 7 which are securely connected with one another. The displacement of a double gear of this type is known to the person skilled in the art and, for this reason, will not be discussed at greater length. This displacement can be effected, for example, by means of the displacement of the pin supporting the spur gears 6, 7. For this purpose, the pin can have a thread on which a nut, which is not displaceable axially, can be rotated by motor. The second spur gear 5 is fastened to the cylinder body 2.

Figure 2:
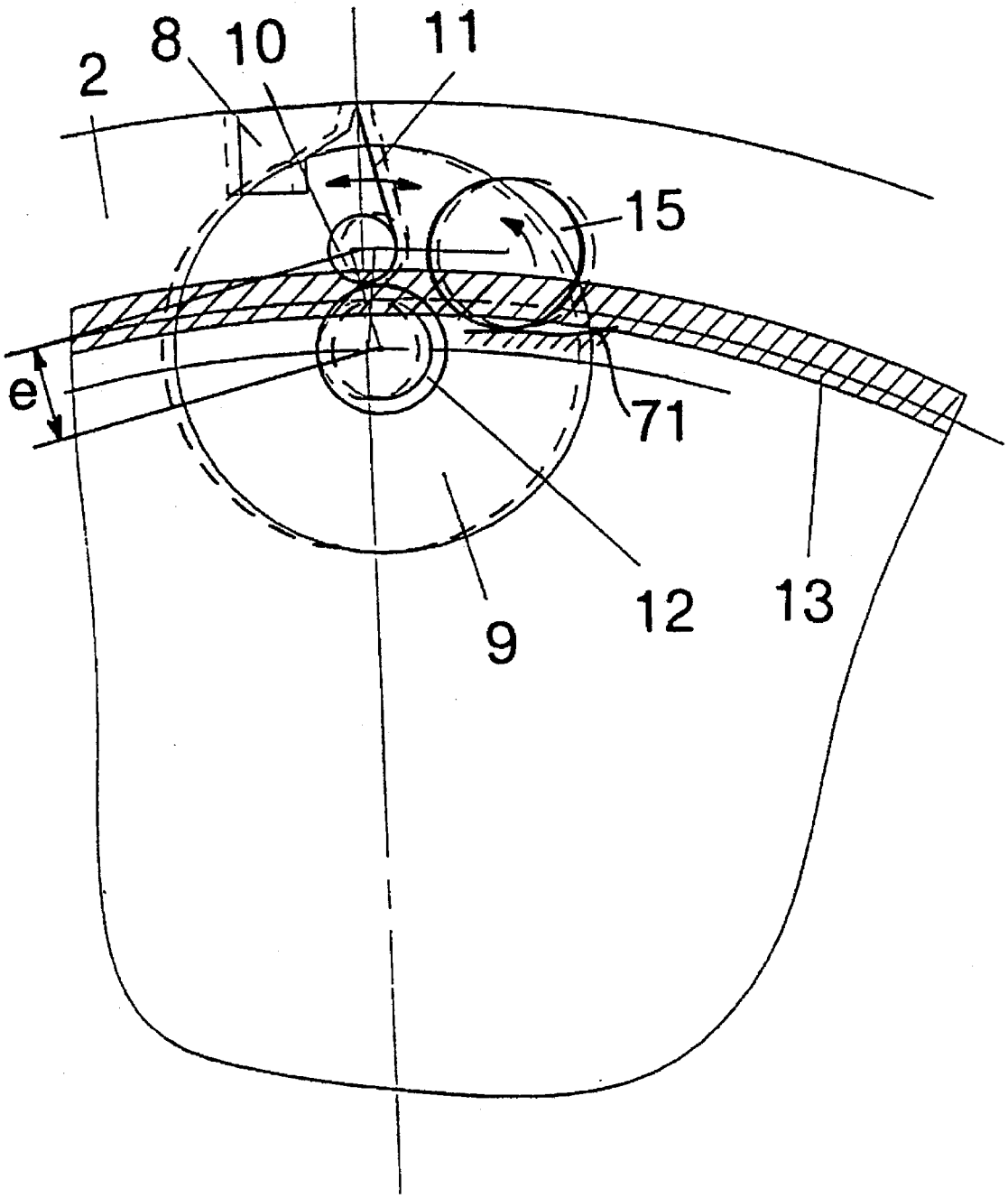
FIG. 2 is a section along line II—II in FIG. 1.

The noncontrolled folding jaw 8 is arranged at the cylinder body 2 in a stationary manner (FIG. 2). Further, a support 9 is swivelably mounted in the cylinder body 2. This support 9 receives a spindle 10 eccentrically (as indicated by "e" in FIG. 2) to its swivel axis, the controlled folding jaw 11 being arranged at this spindle 10. A pinion 12 engages with the internal teeth of a segment 13, which is connected with the cylinder shaft 3 in a stationary manner, and is fastened to the support 9 concentrically in relation to the swivel axis of the support 9. A roller lever 14 supporting a cam roller 15 is located on the spindle 10. The folding jaw cylinder 1 is supported in side walls 18, 19 of a folding apparatus by bearings 16, 17.

The folding jaw cylinder 1 is driven by the first toothed wheel 4 in a manner not shown in the drawing. For the purpose of adjusting the folding jaws 8, 11, the double gear 20 formed by spur gears 6, 7 is displaced. This causes the cylinder body 2 to rotate on the cylinder shaft 3. In so doing, the noncontrolled folding jaw 8 moves toward the controlled folding jaw 11 or away from the latter depending on the direction of displacement. In the illustrated embodiment, adjustment is carried out away from the controlled folding jaw 11 as shown in dashed lines. For this purpose, the displacement of the double gear 20 is effected toward the side wall 18 when this double gear 20 is constructed with the pitch directions shown in the drawing. During this rotation of the cylinder body 2 in the counterclockwise direction, the pinion 12 of the support 9 rolls in the teeth of segment 13 and, in so doing, rotates the support 9 in the clockwise direction. This rotation is accompanied by a swiveling of the spindle 10 and accordingly a swiveling of the folding jaw 11 away from the noncontrolled folding jaw 8 by an amount identical to that by which the folding jaw 8 has opened. The folding jaw 11 is controlled by means of the roller lever 14 with the cam roller 15 which rolls on a cam disk, 71.

Figure 3:
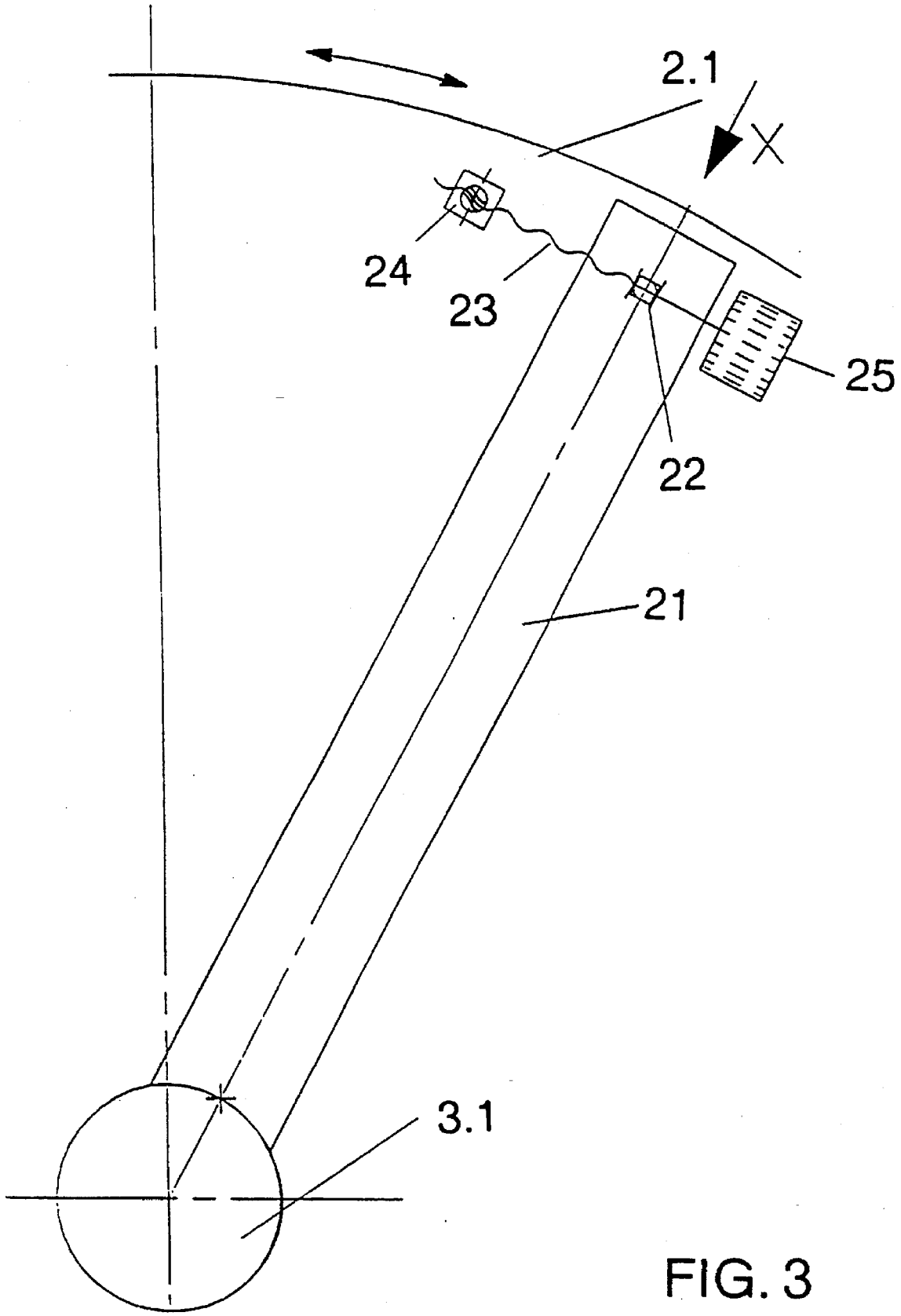
FIG. 3 shows another embodiment of the adjusting apparatus shown in FIG. 1.
Figure 4:
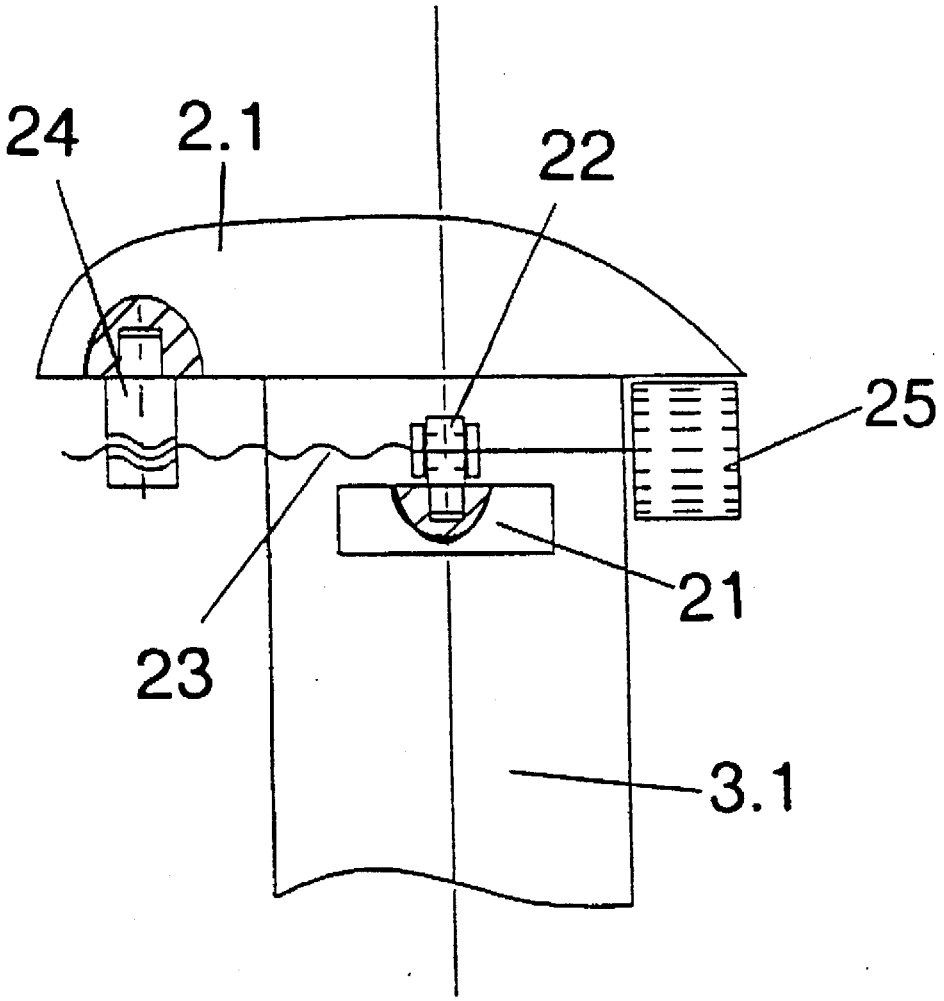
FIG. 4 is a view X according to FIG. 3.

FIGS. 3 and 4 shows a modification of the folding jaw adjustment described above with manual adjustment. The double gear 20 and spur gear 5 are dispensed with. The other component parts reappearing in this construction without any change in function are not described again and their reference numbers are supplemented by ".1". Similarly, the reference numbers in the following embodiments are supplemented by ".2", ".3", etc. A segment 21 is located at the end face of the cylinder body 2.1 and is connected in a stationary manner with the cylinder shaft 3.1. A bearing pin 22 is inserted in this segment 21 so as to be rotatable, and a threaded spindle 23 is supported in the bearing pin 22. This threaded spindle 23 is screwed into a spindle nut 24 which is rotatably supported in the cylinder body 2.1.

When the threaded spindle 23 is rotated via the knurled handle 25, the cylinder body 2.1 is displaced relative to the segment 21 and, given the appropriate rotating direction of the threaded spindle 23, the noncontrolled folding jaw 8.1 occupies the position shown in dashes. The controlled folding jaw 11.1 swivels into the position shown in dashes in the manner already described in the preceding embodiment.

Figure 5:
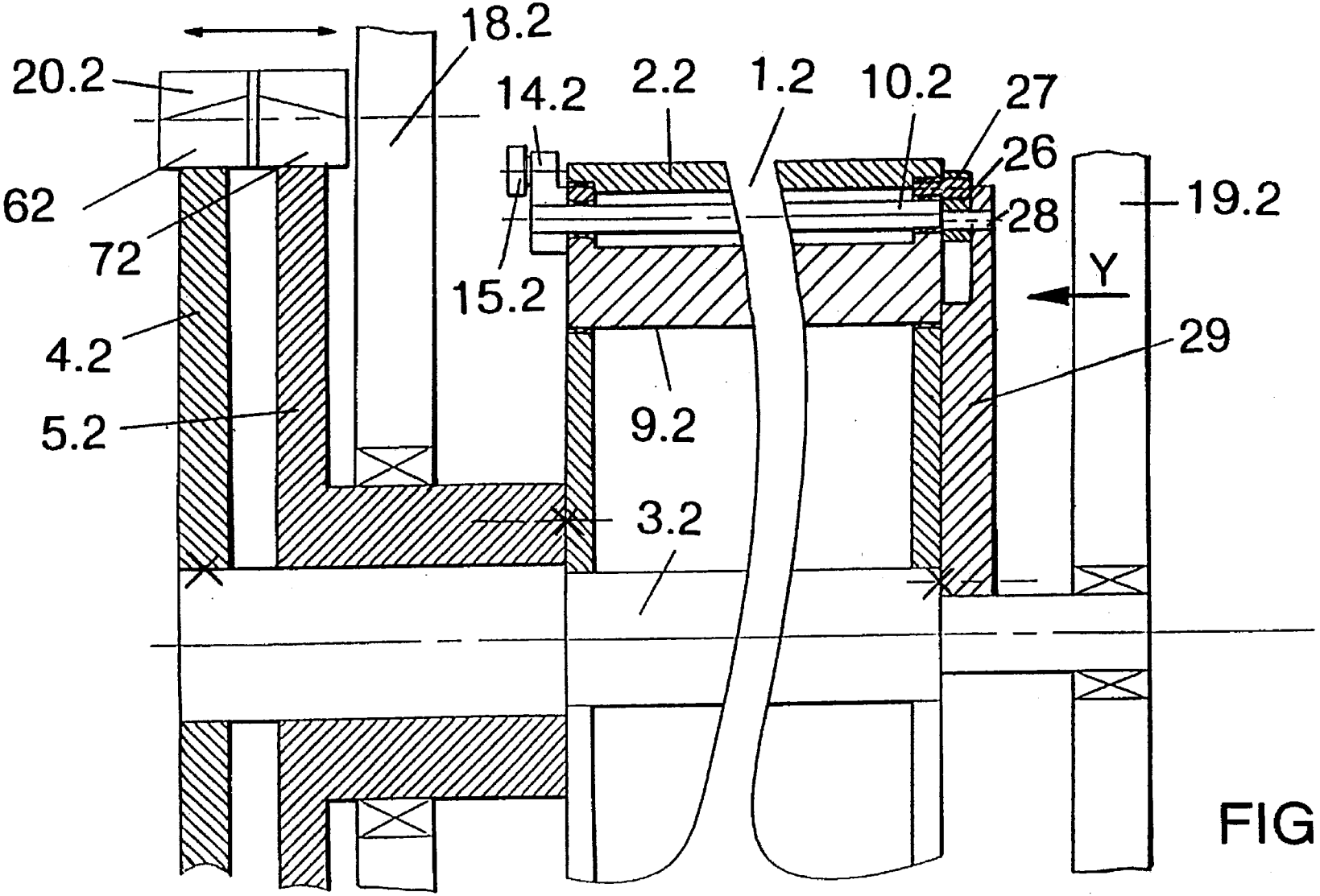
FIG. 5 shows a variant of the adjusting apparatus shown in FIG. 2.
Figure 6:
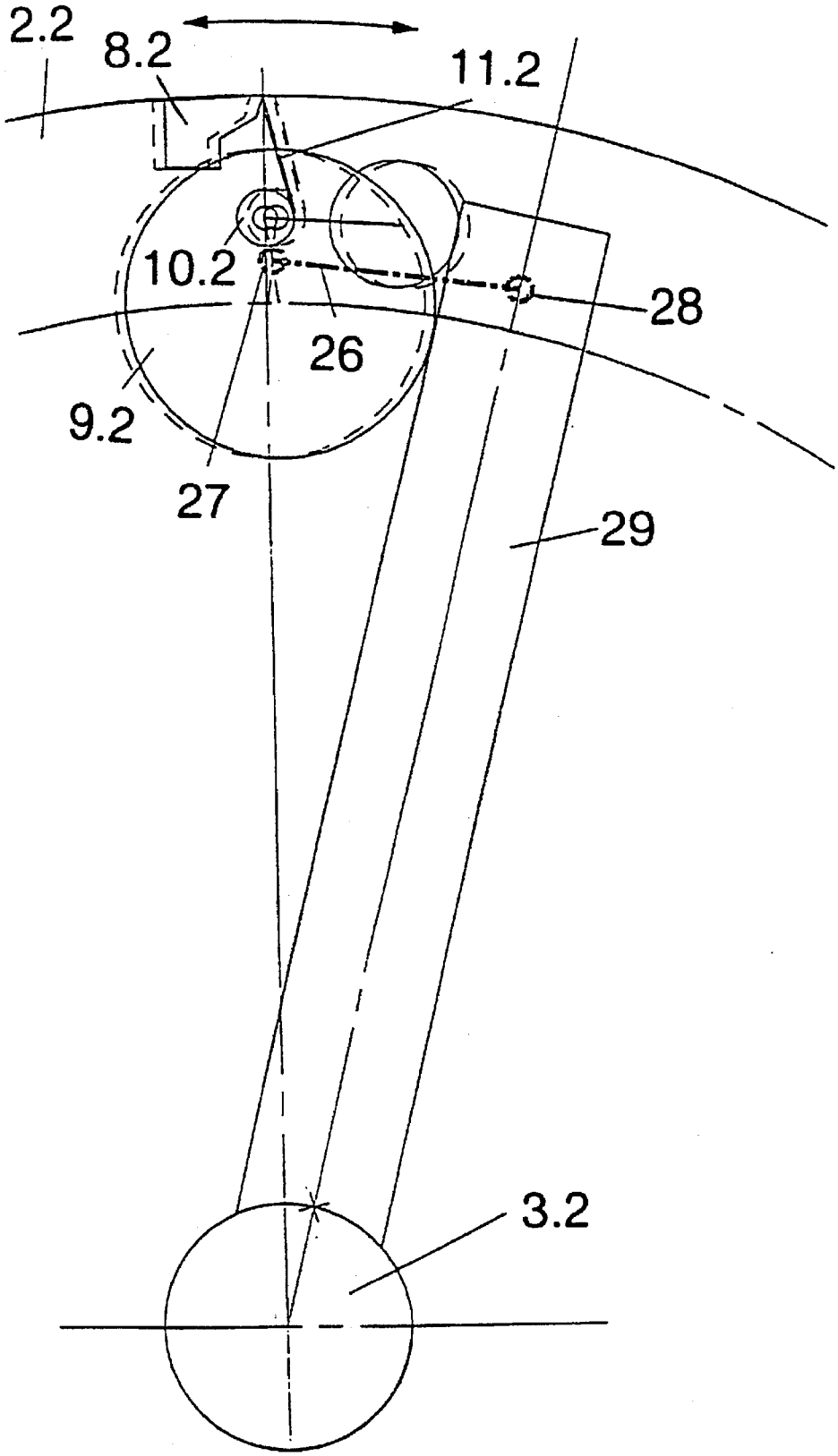
FIG. 6 is a view Y according to FIG. 5.

FIGS. 5 and 6 show another gear unit for swiveling the support 9 during the adjustment of the cylinder body 2. The folding jaw cylinder 1.2 contains a first spur gear 4.2 and a second spur gear 5.2 similar to FIG. 1, as well as a double gear 20.2. Depending on the direction of displacement of the double gear 20.2, the cylinder body 2.2 is displaced along with the noncontrolled folding jaw 8.2, e.g., into the position shown in dashed lines in FIG. 6. However, the swiveling of the support 9.2 with the controlled folding jaw 11.2 is effected by means of a coupling gear unit. This coupling gear unit contains a coupling 26 which is articulated at the support 9.2 eccentrically to its swivel axis by means of pins 27, 28 and at a web or crosspiece 29 fastened to the cylinder shaft 3.2. When the support 9.2 moves away from the crosspiece 29, the coupling 26 swivels the support 9.2 and in so doing moves the controlled folding jaw 11.2 into the position shown in dashed lines. When the folding jaw is adjusted in the other direction, the coupling 26 exerts a pressing action on the support 9.2 and swivels it in the other direction.

Figure 7:
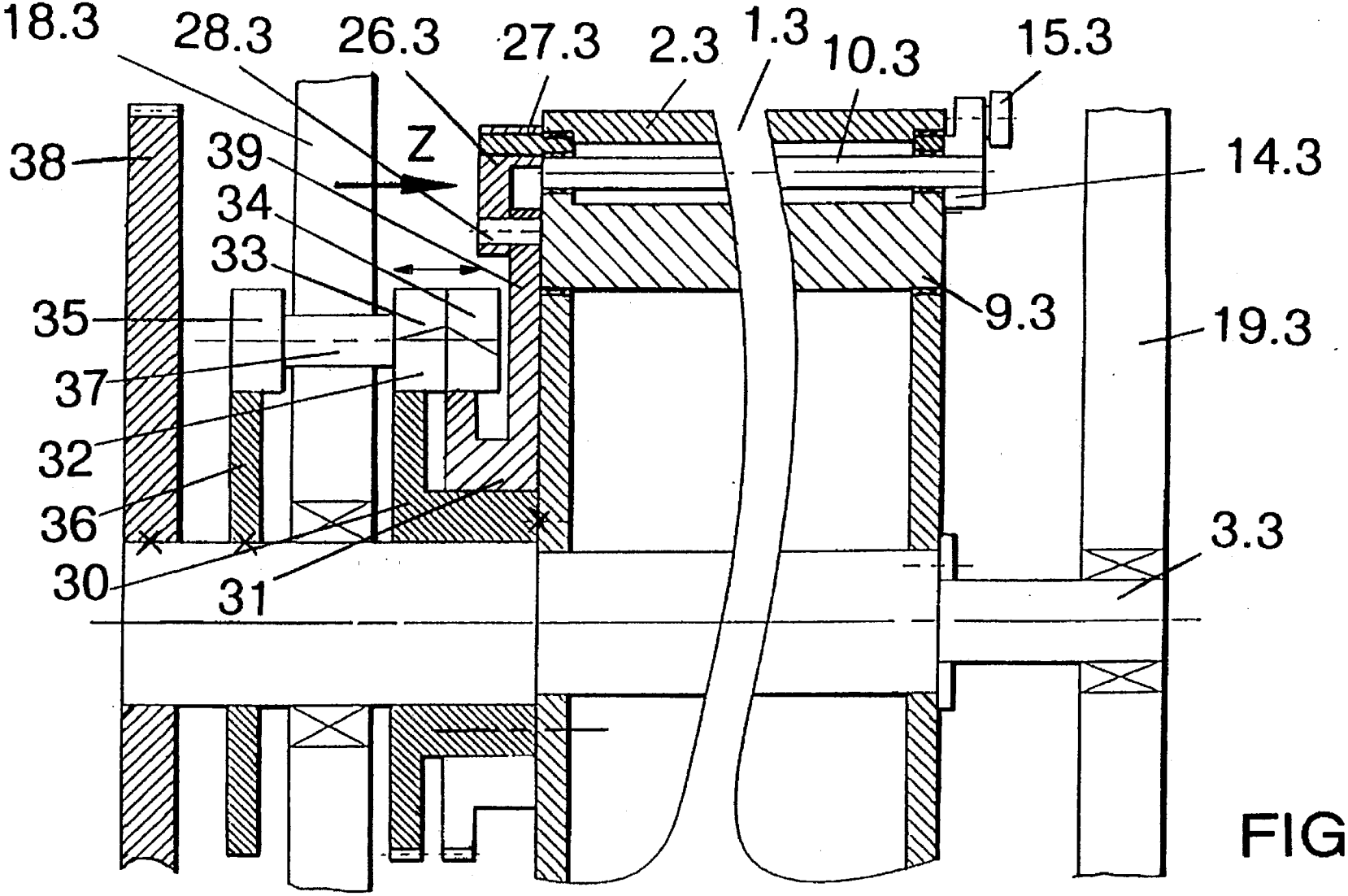
FIG. 7 shows a further variant of the adjusting apparatus shown in FIG. 1.

In FIG. 7, a first spur gear 30 and a second spur gear 31 are arranged concentrically to the cylinder body 2.3. The first spur gear 30 is connected in a stationary manner with the cylinder body 2.3, while the second spur gear 31 is advantageously supported on the hub of the first spur gear 30 so as to be freely rotatable. The two spur gears 30, 31 have the same number of teeth and different pitch and engage with two spur gears 33, 34 which are connected with one another in a stationary manner so as to form a double gear 32. These spur gears 33, 34 have the same rate of rotation and are connected with a third spur gear 35 so as to be fixed with respect to rotation relative to it. This third spur gear 35 meshes with a fourth spur gear 36 arranged on the cylinder shaft 3.3 in a stationary manner. The double gear 32 is displaceable axially. It is advantageously displaceable with an axle 37 on which it is supported so that the third spur gear 35 which is also supported on the axle 37 is displaced along with it, for which reason the third spur gear 35 and fourth spur gear 36 are advantageously constructed with straight teeth. Finally, a fifth spur gear 38 is arranged in a stationary manner on the cylinder shaft 3.3 to drive the folding jaw cylinder 1.3. The rest of the reference numbers followed by .3 correspond to those of the previous embodiments. Thus, a coupling 26.3 is articulated via a pin 27.3 at the support 9.3 eccentrically to its swivel axis and is connected in an articulated manner with a flange 39 of the second spur gear 31 by means of another pin 28.3.

Figure 8:
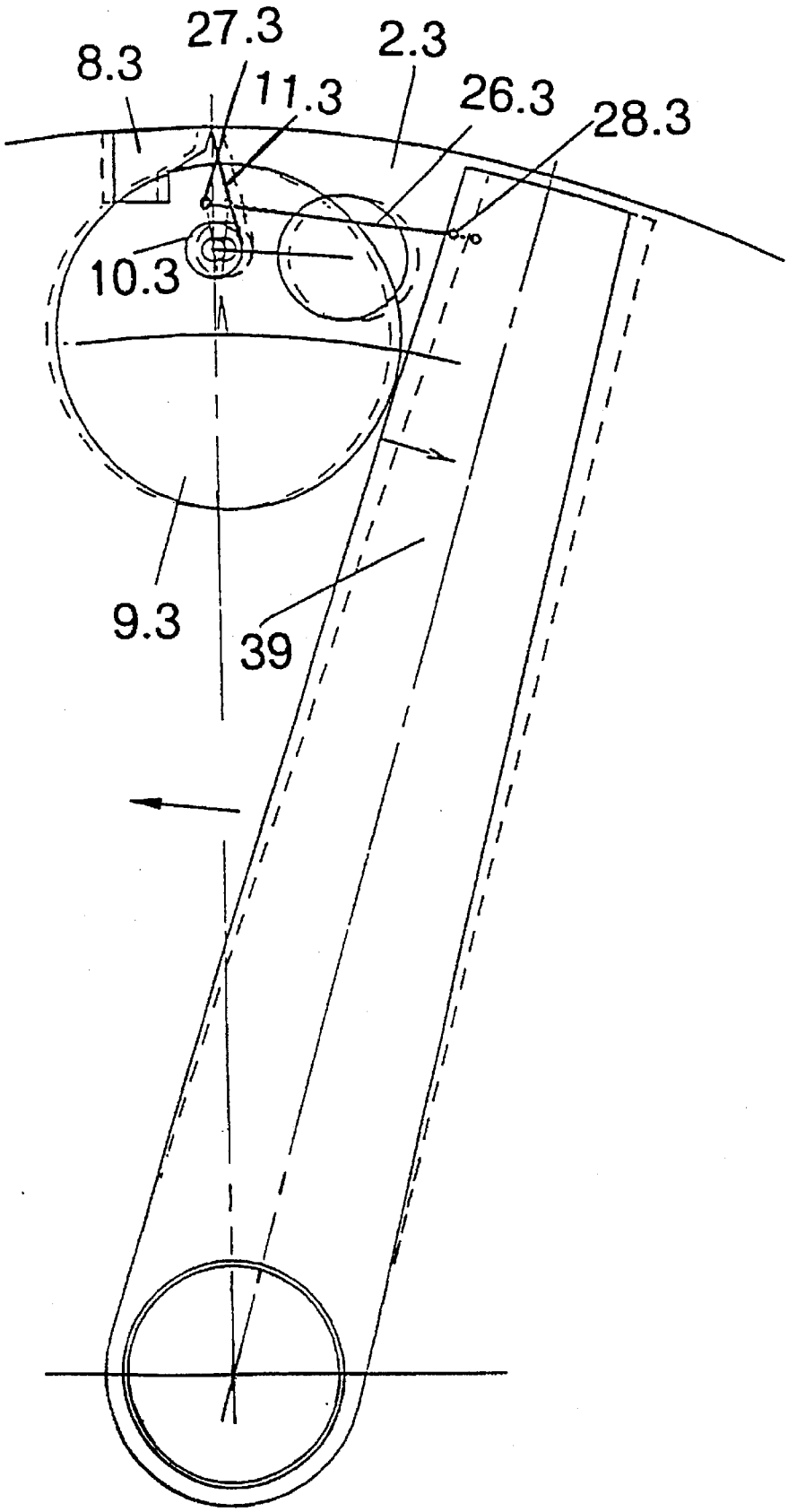
FIG. 8 is a view Z according to FIG. 7.

The folding jaw cylinder 1.3 is driven via the fifth spur gear 38, the fourth spur gear 36, the third spur gear 35 and the double gear 32. The latter drives the first and second spur gear 30, 31 synchronously with the cylinder shaft 3.3. In order to adjust the folding jaws 8.3, 11.3, the double gear 32 is displaced axially. Because of the different pitches of its spur gears 33, 34, the first spur gear 30 and second spur gear 31 rotate relative to one another. In so doing, the cylinder body 2.3 rotates in one direction or the other, depending on the direction of displacement, and offsets the noncontrolled folding jaw 8.3 in a corresponding manner. In the illustrated embodiment, the noncontrolled folding jaw 8.3 is adjusted into the position shown in dashes (FIG. 8) during the displacement of the double gear 32 away from the side wall 18.3. The flange 39, which is simultaneously rotated into the position indicated by dashed lines, rotates the support 9.3 by means of the coupling 26.3 and swivels the controlled folding jaw 11.3 into the position shown in dashed lines.

Figure 9:
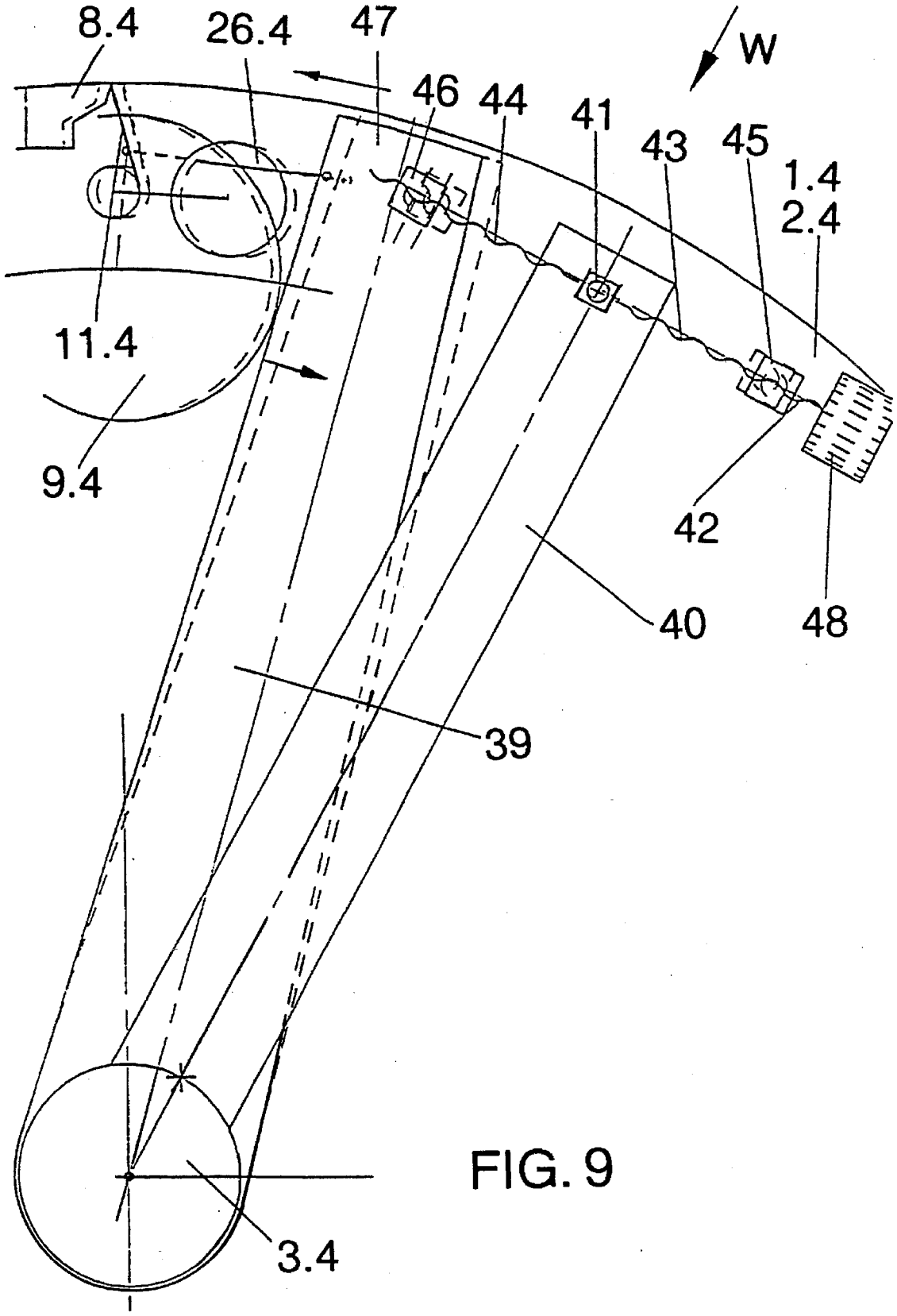
FIG. 9 shows a variant of the adjusting apparatus shown in FIG. 7.
Figure 10:
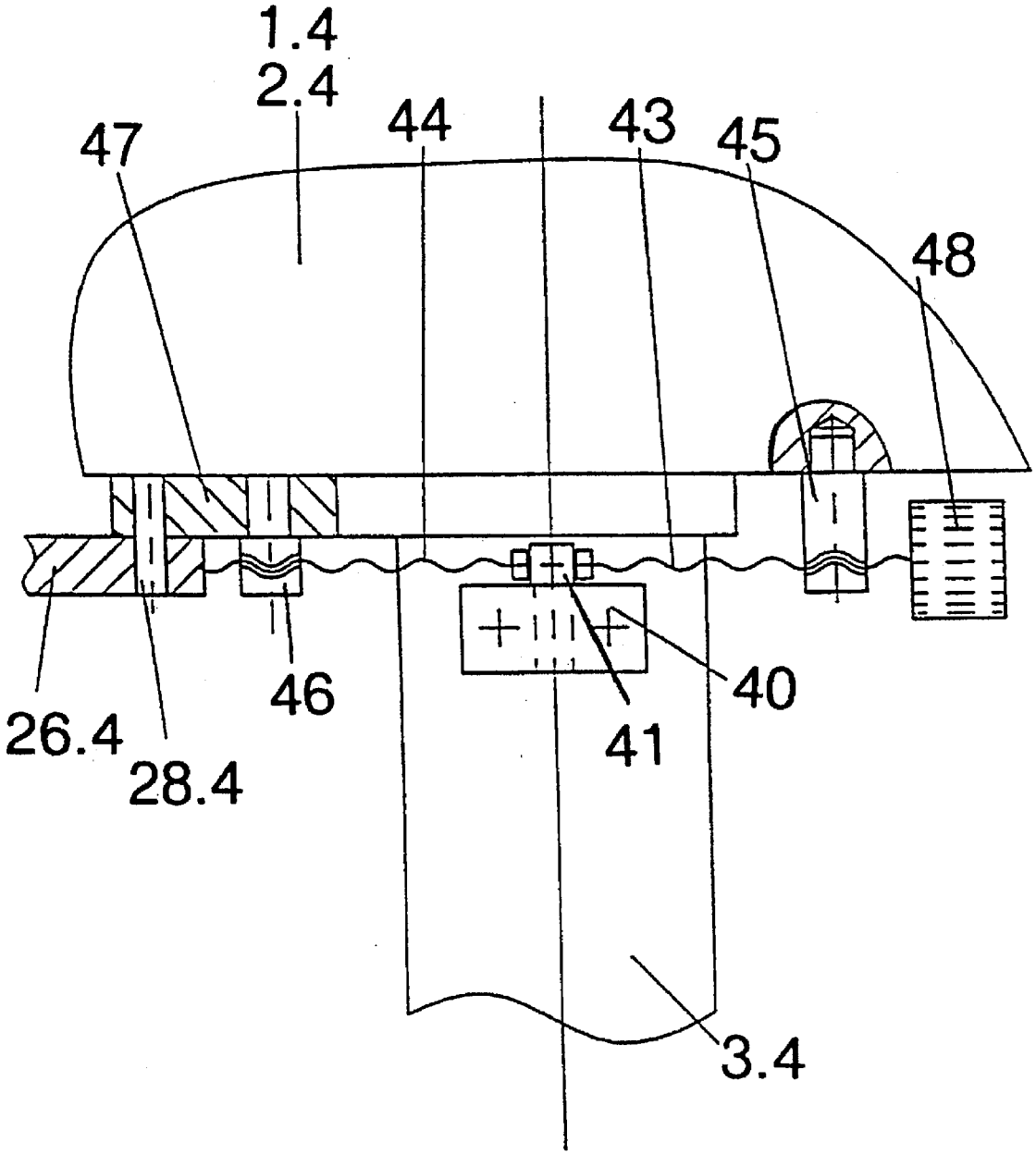
FIG. 10 is a view W according to FIG. 9.

FIGS. 9 and 10 show a manual adjustment for the folding jaws 8.4, 11.4 of a folding jaw cylinder 1.4. For this purpose, a segment 40 is arranged in a stationary manner on the cylinder shaft 3.4 at the end face of the cylinder body 2.4. A bearing pin 41 is inserted into the segment 40 so as to be swivelable and a threaded spindle 42 is supported in this bearing pin 41 so as to be secured against axial displacement. This support has a degree of freedom for displacement in the radial direction. The threaded spindle 42 has two spindle parts 43, 44 of different pitch, i.e., when appropriate, also different pitch directions. One spindle part 43 is screwed into a spindle nut 45 which is inserted in the cylinder body 2.4 so as to be swivelable. The other spindle part 44 is screwed into a spindle nut 46 which is inserted into a segment 47 so as to be rotatable, this segment 47 being swivelable about the cylinder shaft 3.4.

In order to adjust the folding jaws, the threaded spindle 42 is rotated at the knurled handle 48. The folding jaws 8.4, 11.4 are moved away from one another or toward one another depending on the direction of rotation. In the illustrated embodiment, the cylinder body 2.4 is moved in the counterclockwise direction when the threaded spindle is rotated by the spindle nut 45 and the noncontrolled folding jaw 8.4 occupies the position shown in dashes. Further, the spindle part 44 moves the segment 47 in the clockwise direction into the position shown in dashed lines by means of the spindle nut 46. The support 9.4 and, along with it, the controlled folding jaw 11.4 are swiveled into the position shown in dashes by means of the coupling 26.4 which is articulated at the segment 47. The folding jaw cylinder 1.4 is driven by means of the spur gear 38 fastened to its cylinder shaft 3.4.

The dimensioning of the gear unit in the described embodiments lies within the scope of activities of the person skilled in the art. It is also possible, for example, to arrange the coupling 26.3 or 26.4 at the support 9.3 or 9.4 eccentrically toward the cylinder shaft 3.3 or 3.4 in the embodiments according to FIGS. 8 and 9, when the pitch direction of the spur gear 34 or spindle part 44 is the reverse of the pitch directions used in these figures.

The adjustment apparatus which makes use of displacing double gears can also be used to carry out adjustments while the machine is running. When servomotors are used for the displacement of the double gears, remote adjustment can also be carried out. The adjustments by means of the coupling 26 are distinguished by resistance to soiling.

The invention is not limited by the embodiments described above which are presented as examples only but can be modified in various ways within the scope of protection defined by the appended patent claims.

I claim:

1. An apparatus for adjusting folding jaws of a folding jaw cylinder, comprising in combination: a cylinder shaft; a cylinder body rotatably mounted on the cylinder shaft; a controlled folding jaw; a non-controlled folding jaw fastened to the cylinder body; a support member mounted in the cylinder body so as to be swivelable about a swivel axis; a spindle arranged to pass through both the cylinder body and the support member eccentrically to the swivel axis, the controlled folding jaw being arranged and adapted to be received by the support member eccentrically to the swivel axis and so that the controlled folding jaw is swivelable by the spindle; a roller lever and a cam roller connected to the spindle and being operative to control the controlled folding jaw; and gear means for acting on the support member so that when the cylinder body rotates, a swivelling movement is imparted to the support member in a direction which causes the controlled folding jaw to swivel in a direction opposite to movement of the non-controlled folding jaw.

2. An apparatus according to claim 1, and further comprising a first spur gear arranged on the cylinder shaft in a stationary manner, a second spur gear connected to the cylinder body in a stationary manner and arranged on the cylinder shaft so as to be rotatable, and two axially displaceable spur gears of different pitch fixed to one another and arranged to engage with the first and second spur gears.

3. An apparatus according to claim 1, and further comprising a segment member fixed to the cylinder shaft a spindle nut mounted to the cylinder body, and a threaded spindle screwed into the spindle nut and mounted to the segment member so as to be nondisplaceable.

4. An apparatus according to claim 1, and further comprising an internally toothed segment member fixed to the cylinder shaft, and a pinion mounted on the support member so as to engage with the internal teeth of the segment member.

5. An apparatus according to claim 1, and further comprising a crosspiece fixed to the cylinder shaft and coupling means for connecting the support member and the crosspiece with one another in an articulated manner, the coupling means being articulated to the support member eccentrically to the swivel axis of the support member.

6. An apparatus according to claim 1, and further comprising a first spur gear fixed to the cylinder body so as to be concentric therewith, a second spur gear arranged adjacent to the first spur gear and concentric to the cylinder body so as to be rotatable, two axially displaceable spur gears fixed to one another and arranged to mesh with the first and second spur gears, a third spur gear connected to the axially displaceable spur gears so as to be fixed with respect to rotation relative thereto, a fourth spur gear fixed to the cylinder shaft and arranged to engage with the third spur gear, and coupling means for connecting the second spur gear and the support member with one another in an articulated manner, the coupling means being articulated to the support member eccentrically to the swivel axis of the support member.

7. An apparatus according to claim 1, and further comprising a first segment member fixed to the cylinder shaft, a first spindle nut mounted to the cylinder body, a second segment member mounted to be swivelable about the cylinder shaft, a second spindle nut mounted to the second segment member, a threaded spindle connected to the first segment member so as to be fixed against displacement, the spindle having a first spindle part threaded into the first spindle nut and a second spindle part threaded into the second spindle nut, both spindle parts having threads with different pitches, and coupling means for connecting the second segment member and the support member with one another in an articulated manner, the coupling means being articulated to the support member eccentrically to the swivel axis of the support member.

* * * * *